US008196646B2

(12) United States Patent
Huang et al.

(10) Patent No.: US 8,196,646 B2
(45) Date of Patent: Jun. 12, 2012

(54) HEAT EXCHANGER ASSEMBLY

(75) Inventors: Lin-Jie Huang, East Amherst, NY (US); Prasad S. Kadle, Williamsville, NY (US)

(73) Assignee: Delphi Technologies, Inc., Troy, MI (US)

( * ) Notice: Subject to any disclaimer, the term of this patent is extended or adjusted under 35 U.S.C. 154(b) by 712 days.

(21) Appl. No.: 12/334,790

(22) Filed: Dec. 15, 2008

(65) Prior Publication Data

US 2010/0147498 A1 Jun. 17, 2010

(51) Int. Cl.
*F28F 1/22* (2006.01)

(52) U.S. Cl. ..... 165/135; 165/140; 165/153

(58) Field of Classification Search ..... 165/135, 165/151, 182, 140, 146, 153, 183; 29/890.047
See application file for complete search history.

(56) References Cited

U.S. PATENT DOCUMENTS

| | | | | |
|---|---|---|---|---|
| 5,992,514 | A * | 11/1999 | Sugimoto et al. | 165/135 |
| 6,394,176 | B1 | 5/2002 | Marsais | |
| 6,561,264 | B2 * | 5/2003 | Ozaki et al. | 165/140 |
| 6,662,861 | B2 * | 12/2003 | Ozaki et al. | 165/140 |
| 6,837,304 | B2 * | 1/2005 | Makino et al. | 165/135 |
| 6,889,757 | B2 * | 5/2005 | Iwasaki et al. | 165/135 |
| 7,117,933 | B2 * | 10/2006 | Iwasaki et al. | 165/152 |

FOREIGN PATENT DOCUMENTS

| | | | |
|---|---|---|---|
| EP | 1003005 | A1 | 5/2000 |
| EP | 1030153 | A1 | 8/2000 |
| EP | 1088689 | A2 | 4/2001 |
| EP | 1256771 | A1 | 11/2002 |
| EP | 0773419 | B1 | 2/2003 |

* cited by examiner

*Primary Examiner* — Teresa Walberg
(74) *Attorney, Agent, or Firm* — Thomas N. Twomey

(57) ABSTRACT

A heat exchanger assembly including a first and second heat exchangers disposed in sandwiched relationship with one another. The tubes and air fins of the first and second heat exchangers are aligned with one another in a transverse air flow direction. A plurality of middle connecting portions are integral with and extend in the transverse air flow direction between the aligned first and second air fins of the two heat exchangers. Each of the middle connecting portions has a slot for impeding heat conduction between the first and second air fins, and each of the slots in the middle connecting portions is disposed closer to the first tubes than to the second tubes to maximize the effective length of the second air fin.

2 Claims, 2 Drawing Sheets

HEAT EXCHANGER ASSEMBLY

BACKGROUND OF THE INVENTION

1. Field of the Invention

The subject invention relates to a heat exchanger assembly including a first heat exchanger and a second heat exchanger disposed in parallel relationship to one another.

2. Description of the Prior Art

European Patent No. 0,773,419, assigned to Denso (Hereinafter referred to as Denso '419), discloses a heat exchanger assembly comprising a first heat exchanger for receiving a flow of air in a transverse direction and a second heat exchanger disposed adjacent the first heat exchanger for receiving the flow of air in the transverse direction from the first heat exchanger.

The first heat exchanger of the Denso '419 patent includes a plurality of first tubes being spaced from one another and defining a fin space between adjacent first tubes. A plurality of first air fins are disposed in the fin spaces and engage the adjacent first tubes. The second heat exchanger includes a plurality of second tubes being spaced from one another by the fin space and aligned in the transverse direction with the first air fins. A plurality of second air fins are disposed in the fin spaces and engage the adjacent second tubes. The second air fins are aligned in the transverse direction with the first air fins.

The Denso '419 patent further discloses a plurality of middle connecting portions extending in the transverse direction between the aligned first and second air fins through which heat may be conducted. Each of the middle connecting portions defines a slot for reducing heat conduction between the first air fins engaging the first tubes and the second air fins engaging the second tubes. The slots of the middle connecting portions of the Denso '419 patent are disposed halfway between the first and second tubes.

The Denso '419 patent discloses an assembly that includes an air fin engaging both the first tubes of the first heat exchanger and the second tubes of the second heat exchanger and can be manufactured in a continuous and integral strip, thereby reducing the cost of manufacturing. The integral air fin transfers heat from both the first and second heat exchangers to the flow of air while the slot impedes the conduction of heat between the first air fin engaging the first heat exchanger and the second air fin engaging the second heat exchanger.

SUMMARY OF THE INVENTION

The invention provides for such a sandwiched heat exchanger assembly wherein each of the slots in the middle connecting portions is disposed closer to the first tubes of the first heat exchanger than to the second tubes of the second heat exchanger to maximize the heat transfer area and effectiveness of the second fin.

The invention provides an integral air fin that can be manufactured in a continuous strip and impedes the heat transfer between the first air fin engaging the first heat exchanger and the second air fin engaging the second heat exchanger while maximizing the heat transfer area and effectiveness.

The subject heat exchanger can function as an evaporator or a condenser. For example, where the heat exchanger functions as an evaporator, the coolant in the second tubes downstream of the first tubes is colder than the coolant in the first tubes. The average temperature of the middle connecting portion is lower than the middle connecting portion of the prior art because the heat transfer with the warmer first fins is impeded by the slot. The decreased average temperature of the middle connecting portions increases the total heat transfer between the two heat exchangers and the flow of air.

Where the heat exchanger functions as a condenser, the coolant in the second tubes downstream of the first tubes is hotter than the coolant in the first tubes. The average temperature of the middle connecting portion is higher than the middle connecting portion of the prior art because the majority of each of the middle connecting portions has a higher heat conductivity with the hotter second fins than the cooler first fins. The increased average temperature of the middle connecting portions improves the efficiency of the condenser.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE EXEMPLARY EMBODIMENT

Figure 1:
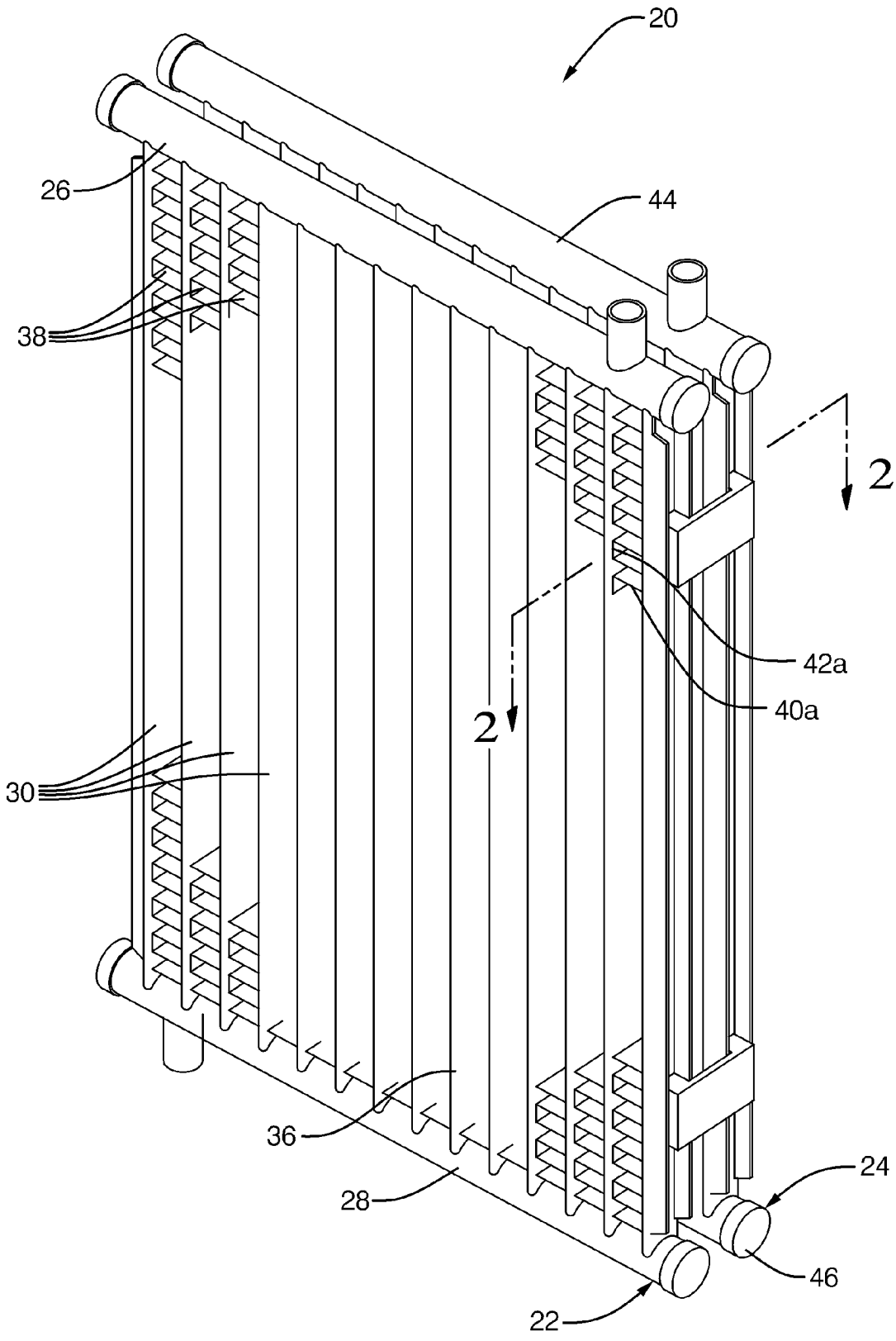
FIG. 1 is a front and perspective view of the subject invention.
Figure 2:
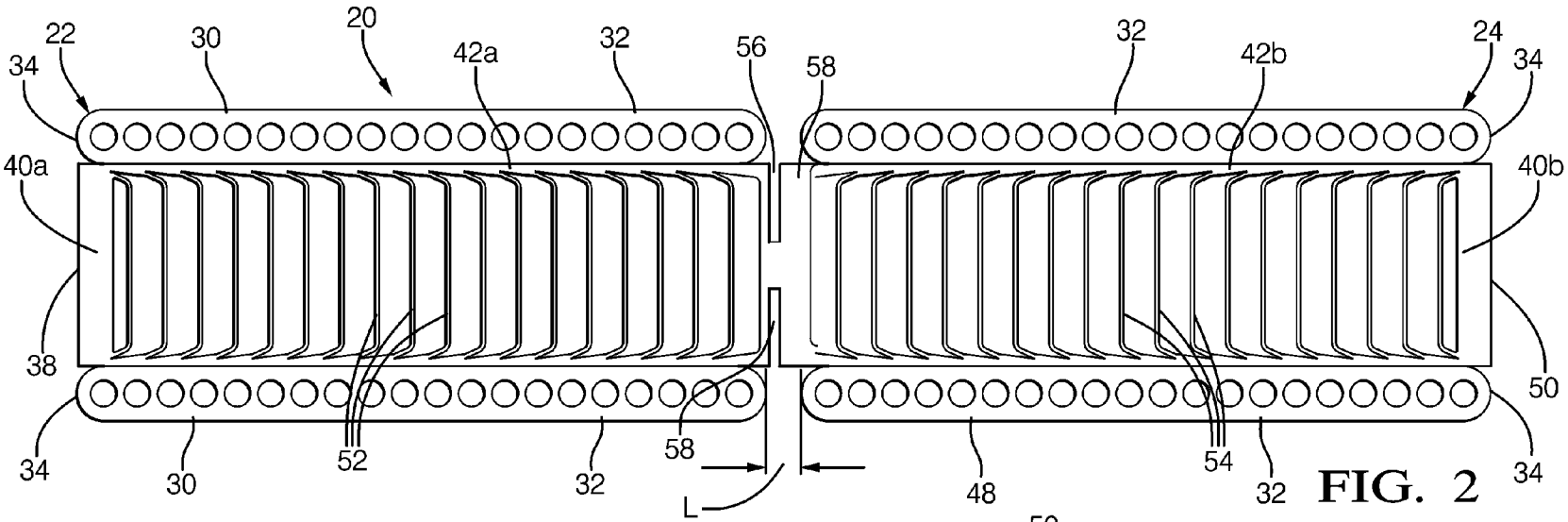
FIG. 2 is a cross-sectional view of the subject invention taken along line 2-2 of FIG. 1.

Referring to the Figures, wherein like numerals indicate corresponding parts throughout the several views, the invention comprises a heat exchanger assembly 20, generally shown, including a first heat exchanger 22 for receiving a flow of air in a transverse direction to transfer heat between the flow of air and a first coolant in the first heat exchanger 22. A second heat exchanger 24 is disposed in sandwiched relationship with the first heat exchanger 22 and extends in parallel relationship therewith for receiving the flow of air in the transverse direction from the first heat exchanger 22 to transfer heat between the flow of air and a second coolant in the second heat exchanger 24. It should be appreciated that the first and second heat exchangers could be substituted for a single cross-counterflow heat exchanger, as will be described in more detail below.

The first heat exchanger 22 includes a first upper manifold 26 and a first lower manifold 28 extending in spaced and parallel relationship to one another. A plurality of first tubes 30 extend in spaced and parallel relationship to one another between the first manifolds, and each of the first tubes 30 has a cross-section presenting flat sides 32 interconnected by round ends 34. The flat sides 32 extend in the transverse direction with the flat sides 32 of adjacent first tubes 30 being spaced from one another by a fin space 36 across the transverse direction.

A plurality of first air fins are disposed in the fin space 36 between the flat sides 32 of the adjacent first tubes 30. Each of the first air fins has a cross-section presenting a plurality of first legs 40 extending perpendicularly between the flat sides 32 of the adjacent first tubes 30. First bases 42 interconnect alternate ends of adjacent first legs 40 and engage the flat sides 32 of the adjacent first tubes 30 to present a serpentine pattern extending between the first manifolds. It should be appreciated that the first air fins may also extend between the flat sides 32 of the first tubes 30 at any angle between the flat sides 32 of the adjacent first tubes 30.

In the exemplary embodiment, the second heat exchanger 24 includes a second upper manifold 44 and a second lower manifold 46 extending in spaced and parallel relationship to one another. The second heat exchanger 24 includes a plurality of second tubes 48 extending in spaced and parallel relationship to one another between the second manifolds. Each of the second tubes 48 has a cross-section similar to the cross-section of the first tubes 30 and presenting flat sides 32 interconnected by round ends 34. Similar to the first tubes 30, the flat sides 32 of the second tubes 48 extend in the transverse direction with the flat sides 32 of adjacent second tubes 48 being spaced from one another by the fin space 36 across the transverse direction. The second tubes 48 are spaced from one another the same as the first tubes 30 so that the second tubes 48 are aligned in the transverse direction with the first tubes 30.

A plurality of second air fins are disposed in the fin spaces 36 between the flat sides 32 of the adjacent second tubes 48. The second air fins are aligned in the transverse direction with the first air fins. Each of the second air fins of the exemplary embodiment has a cross-section presenting a plurality of second legs 40 extending perpendicularly between the flat sides 32 of the adjacent second tubes 48 and being aligned in the transverse direction with the first legs 40 of the first air fins. The second bases engaging the flat sides 32 of the adjacent second tubes 48 and the second legs 40 extending between those second bases present a serpentine pattern extending between the second manifolds.

In the exemplary embodiment, each of the first legs 40 of the first air fins presents a plurality of first louvers 52, and each of the second legs 40 of the second air fins presents a plurality of second louvers 54. The first and second louvers enhance the thermal efficiency of the air to increase heat transfer between the first and second fins and the flow of air.

As described above, the first and second heat exchangers could be combined to form a single, cross-counterflow heat exchanger wherein a coolant flows through a plurality passes. In such a cross-counterflow heat exchanger, the coolant preferably flows through the second tubes 48, which are downstream of the first tubes 30, to define a first pass. The coolant is then directed by either the upper manifolds or the lower manifolds to the first tubes 30, through which it flows to define the second pass.

The fins further include a plurality of middle connecting portions 56 being integral with and extending in the transverse direction between the aligned first and second air fins through which heat may be conducted. The middle connecting portions 56 have a length defining the distance between the first and second heat exchangers. Each of the middle connecting portions 56 defines a slot 58 for impeding heat conduction between the first air fins engaging the first tubes 30 and the second air fins engaging the second tubes 48. Each of the slots 58 in the middle connecting portions 56 is disposed closer to the first tubes 30 than to the second tubes 48 for maximizing the heat transfer area and effectiveness of the integral air fin.

Figure 3:
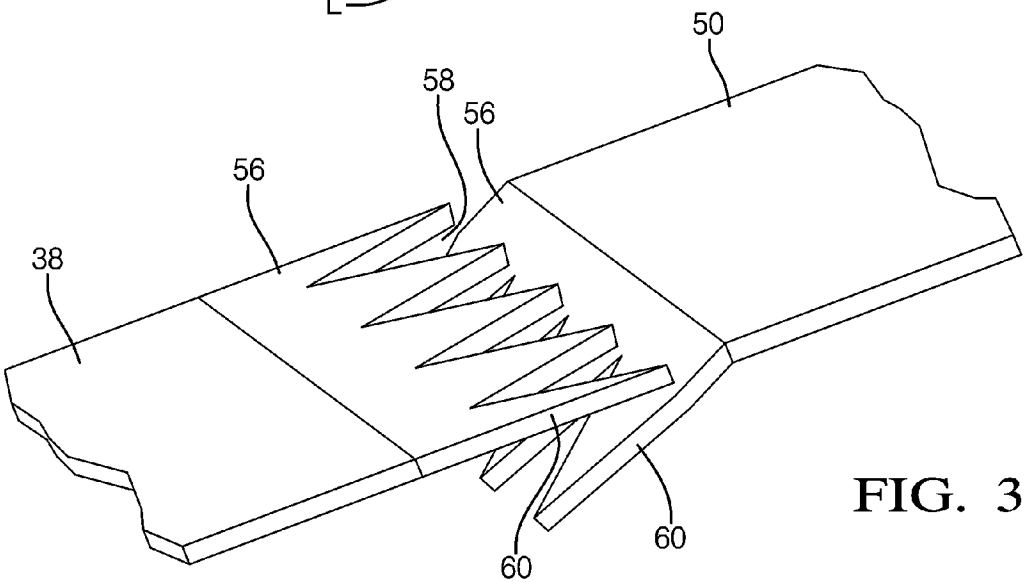
FIG. 3 is a fragmentary and perspective view of one of the slots of the middle connecting portions.

As best shown in FIG. 3, each of the middle connecting portions 56 defines a serrated edge 60 at the slot 58 for inducing turbulence in the flow of air to increase heat transfer between the flow of air and said second air fins. The serrated edge 60 disposed adjacent either the first air fin or the second air fin is bent inwardly into the fin space 36.

The heat exchanger assembly 20 of the exemplary embodiment can be used as either a cross-counterflow evaporator, a plurality of evaporators, a cross-counterflow condenser, or a plurality of condensers.

In operation as a cross-counterflow evaporator or series of evaporators, the coolant flowing through the second tubes 48 is cooler than the coolant flowing through the first tubes 30. The second air fins, therefore, are cooler than the first air fins because of the reduced heat conduction therebetween by the slot 58 in the middle connecting portion 56. The overall efficiency of the evaporator is increased because the majority of the middle connecting portion 56 is in contact with the second fins, and therefore is cooler than the first air fins. The cooler middle connecting portions 56 thereby absorb an increased amount of heat. The heat exchanger assembly 20 functions in the same manner as a cross-counterflow condenser or a series of condensers, except the coolant flowing through the second tubes 48 is hotter than the coolant flowing through the first tubes 30, and therefore the majority of the middle connecting portion 56 is hotter than the first tubes 30.

It is to be understood that "upper" and "lower" as used in the present application are arbitrary, inasmuch as a heat exchanger in accordance with the present invention can be oriented in different directions. Therefore, "upper" and "lower" should be understood to be used with reference to the orientation of the manifolds as shown in the drawings herein, and is not limiting the orientation of the manifolds in actual use.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A heat exchanger assembly comprising:

a first heat exchanger for receiving a flow of air in a transverse direction;

a second heat exchanger disposed adjacent said first heat exchanger for receiving the flow of air in said transverse direction from said first heat exchanger;

said first heat exchanger including a plurality of first tubes being spaced from one another and defining a fin space between adjacent first tubes;

a plurality of first air fins disposed in said fin spaces and engaging said adjacent first tubes;

said second heat exchanger including a plurality of second tubes being spaced from one another by said fin space and aligned in said transverse direction with said first tubes;

a plurality of second air fins disposed in said fin spaces and engaging said adjacent second tubes and being aligned in said transverse direction with said first air fins;

a plurality of middle connecting portions extending in said transverse direction between said aligned first and second air fins through which heat may be conducted;

each of said middle connecting portions defining a slot for reducing heat conduction between said first air fins engaging said first heat exchanger and said second air fins engaging said second heat exchanger for impeding heat transfer between the first air fin and second air fins; and each of said slots in said middle connecting portions being disposed closer to said first tubes than to said second tubes for maximizing the heat transfer area and effectiveness of said second air fins;

wherein each of said middle connecting portions defines a serrated edge at said slot for inducing turbulence in the flow of air to increase heat transfer between the flow of air and said second air fins.

2. A heat exchanger assembly comprising:

a first heat exchanger for receiving a flow of air in a transverse direction to transfer heat between the flow of air and a first coolant in said first heat exchanger;

a second heat exchanger disposed in sandwiched relationship with said first heat exchanger and extending in parallel relationship therewith for receiving the flow of air in said transverse direction from said first heat exchanger to transfer heat between the flow of air and a second coolant in said second heat exchanger;

said first heat exchanger including a first upper manifold and a first lower manifold extending in spaced and parallel relationship to one another;

said first heat exchanger including a plurality of first tubes extending in spaced and parallel relationship to one another between said first manifolds;

each of said first tubes having a cross-section presenting flat sides extending in said transverse direction interconnected by round ends with said flat sides of adjacent first tubes spaced from one another by a fin space across said transverse direction;

a plurality of first air fins disposed in said fin space between said flat sides of said adjacent first tubes;

each of said first air fins having a cross-section presenting a plurality of first legs extending perpendicularly between said flat sides of said adjacent first tubes and first bases interconnecting alternate ends of adjacent first legs and engaging said flat sides of said adjacent first tubes to present a serpentine pattern extending between said first manifolds;

each of said first legs of said first air fins presenting a plurality of first louvers;

said second heat exchanger including a second upper manifold and a second lower manifold extending in spaced and parallel relationship to one another;

said second heat exchanger including a plurality of second tubes extending in spaced and parallel relationship to one another between said second manifolds;

each of said second tubes having a cross-section presenting flat sides extending in said transverse direction interconnected by round ends with said flat sides of adjacent second tubes spaced from one another by said fin space across said transverse direction;

said second tubes being spaced from one another across said fin space the same as said first tubes with said second tubes being aligned in said transverse direction with said first tubes;

a plurality of second air fins disposed in said fin space between said flat sides of said adjacent second tubes and being aligned in said transverse direction with said first air fins;

each of said second air fins having a cross-section presenting a plurality of second legs extending perpendicularly between said flat sides of said adjacent second tubes and being aligned in said transverse direction with said first legs of said first air fins and second bases engaging said flat sides of said adjacent second tubes to present a serpentine pattern extending between said second manifolds;

each of said second legs of said second air fins presenting a plurality of second louvers;

a plurality of middle connecting portions being integral with and extending in said transverse direction between said aligned first and second air fins and having a length defining the distance between said first and second heat exchangers through which heat may be conducted;

each of said middle connecting portions connecting said first and second air fins defining a slot for reducing heat conduction between said first air fins engaging said first heat exchanger and said second air fins engaging said second heat exchanger; and each of said slots in said middle connecting portions being disposed closer to said first tubes than to said second tubes;

wherein each of said middle connecting portions defines a serrated edge at said slot for inducing turbulence in the flow of air to increase heat transfer between the flow of air and said second air fins.

* * * * *